United States Patent [19]

Arndt

[11] Patent Number: 4,623,093

[45] Date of Patent: Nov. 18, 1986

[54] COMBINATION DISCHARGE AND SUPPLY FITTING FOR HOT WATER TANK

[75] Inventor: William C. Arndt, Michigan City, Ind.

[73] Assignee: The Marley-Wylain Company, Michigan City, Ind.

[21] Appl. No.: 597,474

[22] Filed: Apr. 6, 1984

[51] Int. Cl.[4] ..... F24D 3/08

[52] U.S. Cl. ..... 237/19; 237/56

[58] Field of Search ..... 137/590; 237/61, 19, 237/56, 8 R; 126/362, 363

[56] References Cited

U.S. PATENT DOCUMENTS 3,096,021 7/1968 Lintvedt ..... 236/20 R 4,416,222 11/1983 Staats ..... 237/19

*Primary Examiner*—Henry Bennett

*Attorney, Agent, or Firm*—Schmidt, Johnson, Hovey & Williams

[57] ABSTRACT

Compact, easily installable apparatus is disclosed for attachment to a conventional domestic hot water heater tank using only the preexisting threaded drain valve opening normally provided, in order to convert the heater into a simple storage tank and effect water heating externally of the existing heater in an indirect heat exchanger coupled to, for example, an existing boiler forming a part of a space heating system. In this fashion energy savings can be realized inasmuch as boiler water is used for heating the domestic water supplies, as opposed to separate firing of the hot water tank. The apparatus of the invention preferably includes a circulator fitting having a housing and a pair of interfitted, outer and inner, water withdrawal and delivery pipes designed for coupling to the single threaded valve opening in the water heater tank, thereby avoiding the need to drill additional holes through the tank wall; in addition, a compact pump unit is affixed to the fitting housing for moving water through the system as needed. A coaxial coil heat exchanger is also provided, along with appropriate conduits for coupling the exchanger to the tank fitting housing and boiler respectively.

1 Claim, 6 Drawing Figures

COMBINATION DISCHARGE AND SUPPLY FITTING FOR HOT WATER TANK

BACKGROUND OF THE INVENTION

1. Field of the Invention

The present invention is broadly concerned with improved apparatus for converting a conventional hot water heater into a simple water storage container, and to permit heating of domestic water supplies externally of the heater tank by making use of an existing boiler forming a part of a space heating system. More particularly, it is concerned with such apparatus which in preferred forms includes a double-pipe fitting which can be secured directly to an existing hot water tank using only the threaded drain valve opening normally provided therein, thereby completely avoiding the necessity of drilling additional holes through the heater tank wall.

2. Description of the Prior Art

The energy consumed by a typical hot water heater in a residence or small building in order to provide adequate supplies of hot domestic water is generally very considerable; indeed, in some cases one-third or more of the total household energy consumption may be devoted to heating of water. Obviously, the dramatic rise in energy costs experienced during the last decade has focused attention upon all energy intensive devices, and hot water tanks are no exception. Modern day hot water tanks are therefore provided with significant insulation and other energy saving features. Nevertheless, energy consumption by these units is still significant.

One proposal for reducing energy usage in the context of hot water heating is to convert an existing hot water heater to a simple storage tank, and to provide heating for the water externally of the tank in an indirect heat exchanger coupled to an existing boiler forming a part of an heating system for the residence or building. In other contexts heat derived from a solar collector system or a waste heat source can be employed. From a theoretical standpoint, the proposal has a number of advantages, principally stemming from the fact that but a single heating device (i.e., the heating system boiler) is employed for heating domestic water supplies as well as water used in the space heating system. Typically, boilers of this type are more efficient than hot water heaters, and therefore reductions in energy consumption are realized.

While the foregoing proposal has a number of advantages, from a practical standpoint the task of converting a conventional hot water heater tank for use in the described system can be a formidable one. To give but one example, hot water heater tanks are normally provided with only a single threaded drain opening proximal to the lower end of the tank, for receiving a spigot-type drain valve. Thus, a straightforward conversion of a normal hot water heater tank requires drilling of at least one additional hole through the tank wall, in order to provide the necessary water circulation lines for moving water to and from the external heat exchanger. Obviously, such modifications of an existing hot water heater tank are beyond the skills of the average homeowner, thereby requiring professional assistance and consequent significant expense.

Accordingly, while the concept of hot water heater tank conversion and external heating of domestic hot water supplies is an attractive one, the practical difficulties associated with implementation of the idea have prevented its widespread adoption. Thus, any apparatus which would facilitate such conversions would be a decided advantage, and would be economically attractive in view of the potential reductions in energy consumption which could be achieved.

SUMMARY OF THE INVENTION

The present invention overcomes the problems noted above, and provides apparatus adapted for use with an existing, conventional, separate hot water heater having a tank with a drain opening through the tank wall thereof proximal to the lower end of the tank, in order to quickly and efficiently convert the heater tank to a simple storage tank and permit external heating of domestic water supplies. Broadly speaking, the apparatus of the invention includes a pair of interfitted, inner and outer water-conveying pipes which cooperatively present respective inner and outer water flow passages. Means is provided for connecting one end of the interfitted pipes to the tank at the tank opening, with both of the passageways being in communication with the interior of the tank through the single tank opening. The overall apparatus further includes an indirect heat exchanger separate from the tank and having a cold water inlet and a heated water outlet; the exchanger is operable for receiving initially cold water from the tank and conveying the same in indirect thermal interchange relationship with initially hot heat exchange media derived from a source separate from the tank (e.g., the boiler of a space heating system, a solar collector system or a waste heat source), in order to heat the water.

The apparatus of the invention further includes a water-conveying assembly having first and second conduit means; the first conduit serves to operably couple one of the interfitted pipes and the inlet of the heat exchanger, whereas the second conduit serves to operably couple the other of the interfitted pipes and the exchanger hot water outlet. In this fashion, a continuous conduit loop is provided between the hot water heater tank and the external heat exchanger, using only the single opening normally provided with the tank.

Pump means also forms a part of the apparatus of the invention, and is operably interposed within the water-conveying system for selectively withdrawing initially cold water from the tank through one of the interfitted pipes, and conveying the cold water through the first conduit and exchanger in order to heat the water, whereupon hot water is delivered from the exchanger outlet and second conduit back into the tank for household use.

In particularly preferred forms, the end of the interfitted pipes remote from the tank are operably coupled with a housing having walls defining an internal chamber, and one of the pipes is in communication with the internal housing chamber. In this embodiment, the pump means referred to above is advantageously affixed to the housing, with a port being provided for communicating the inlet of the pump and the internal housing chamber. In this fashion, a compact, easily installable circulator fitting comprising the housing, interfitted water-conveying pipes, and a pump unit, can be provided.

DESCRIPTION OF THE PREFERRED EMBODIMENTS

Figure 1:
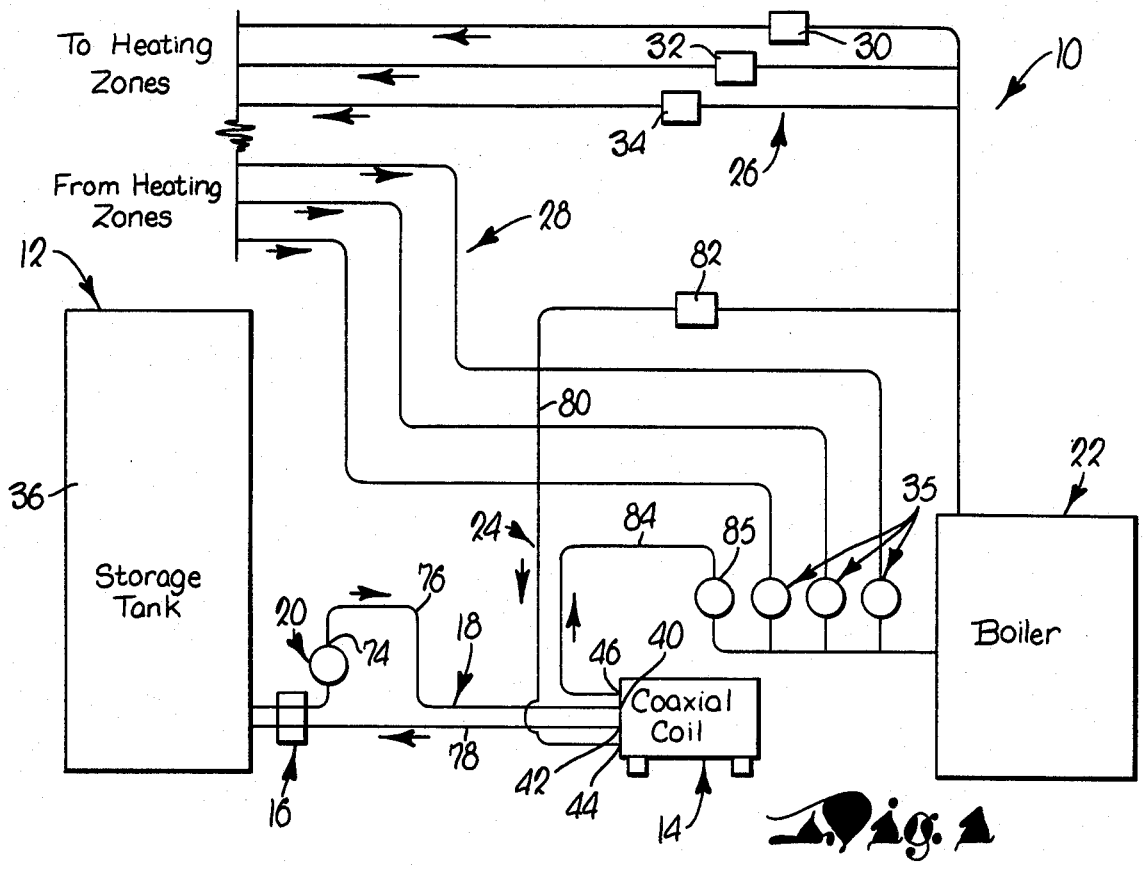
FIG. 1 is a schematic representation of a water heating system in accordance with the invention, wherein a conventional hot water heater is converted into a simple storage tank, and domestic water is heated externally of the tank in a heat exchanger, the latter being operably coupled with a boiler forming a part of a zoned space heating system.

Turning now to the drawings, an overall water heating system 10 is schematically illustrated in FIG. 1. Broadly speaking, the system 10 includes a conventional hot water heater 12 which has been converted into a simple storage tank as hereinafter described, and an external coaxial coil heat exchanger 14. The heat exchanger 14 and water heater 12 are operatively coupled by means of a specialized fitting 16, water-conveying conduit system 18, and pump 20, in order that water can be selectively withdrawn from heater 12 for heating in exchanger 14, with return of heated water from the exchanger to the heater 12.

In addition to the foregoing, the overall system 10 further includes a boiler 22 forming a part of a space heating apparatus. Appropriate conduits 24 are provided for operatively coupling the boiler 22 and heat exchanger 14 in the manner to be described. Finally, FIG. 1 illustrates the usual delivery and return zone heating lines 26 and 28, with the delivery lines 26 being provided with appropriate flow control valves 30–34, whereas the return lines 28 have conventional pumps 35 interposed therein.

In more detail, it will be appreciated that hot water heater 12 is of entirely conventional design, and includes an upright tank-defining wall 36 having a threaded drain opening 38 therethrough (see FIGS. 4–5) close to the lower end of the tank. Normally, a drain cock of the usual design is threaded into opening 38, so that the tank can be drained at will.

In like manner, the preferred heat exchanger 14 is of known coaxial coil design, and includes a cold water inlet 40 and a heated water outlet 42 for domestic water supplies, along with a heat exchange media inlet 44 and a media outlet 46.

Figure 2:
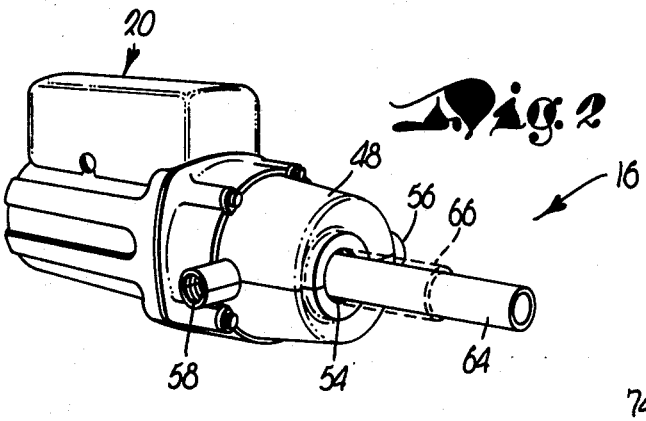
FIG. 2 is a perspective view of a circulator fitting in accordance with the invention.
Figure 4:
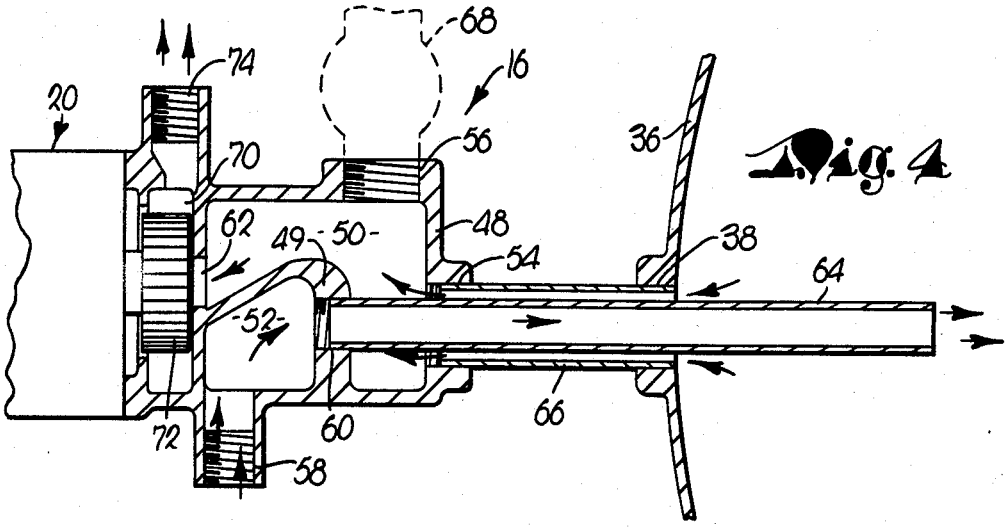
FIG. 4 is a fragmentary, enlarged, partial top sectional view of the circulator fitting illustrated in FIG. 2, operatively connected to a conventional hot water heater in order to convert the latter into a simple storage tank.

The preferred circulator fitting 16 is illustrated in FIGS. 2 and 4. The fitting 16 includes a housing 48 having walls (including wall 49) defining a pair of internal, non-communicating, separate chambers 50, 52. In addition, the housing has a pair of threaded openings 54, 56 which are in communication with chamber 50, and a threaded opening 58 in communication with the other chamber 52. Finally, internal wall 49 is provided with a threaded opening 60, whereas a port 62 communicates with chamber 50 through a wall of housing 48 remote from the wall including the threaded opening 54 (see FIG. 4).

The overall fitting 16 further includes a pair of elongated, substantially coaxially interfitted, inner and outer water-conveying pipes 64, 66. As best seen in FIG. 4, the outer pipe 66 is threadably received within the opening 54, whereas the longer inner pipe 64 is threadably received within opening 60. Thus, it will be observed that the inner water flow passageway presented by the pipe 64 communicates with chamber 52, with the larger diameter outer pipe 66 communicating with separate chamber 50. Moreover, the end of pipe 66 remote from housing 48 is threadably received within tank wall opening 38, with the smaller diameter central pipe 64 extending well into the confines of the water heater 12. In preferred forms, a drain cock 68 is installed in opening 56, in order to provide a drain function as desired.

Although the pump 20 illustrated in FIG. 1 is depicted as being separate from the fitting structure, in preferred forms the pump is affixed to and in effect forms a part of the housing 48. To this end, the pump 20 includes walls defining a chamber 70 having a rotatable impeller 72 situated therein. An outlet opening 74 is also provided which communicates with the chamber 70. It will further be observed that port 62 serves to communicate the chambers 50, 70 of housing 48 and pump 20 respectively.

The conduit system 18 includes a first conduit 76 which is operatively coupled between opening 74 of pump 20 and cold water inlet 40 of exchanger 14; a second conduit 78 is also provided, which is operatively coupled between hot water outlet 42 of exchanger 14, and opening 58 provided in housing 48. A study of FIGS. 1 and 4 will confirm that water may therefore be drawn from the heater 12 through outer pipe 66, chamber 50, port 62 and opening 74 for passage through conduit 76 to the exchanger 14. Return of heated water is provided through conduit 78, opening 58, chamber 52 and inner pipe 64.

As noted above, the boiler 22 is of conventional construction and serves to efficiently heat volumes of hot water for use in the space heating system for the building in question. However, additional conduits 24 are provided in this case for delivery and return of water from the heat exchanger 14. To this end, a hot water delivery line 80 is provided which is operatively coupled to media inlet 44 above exchanger 14, and to the hot water delivery main coupled to the zone heating lines 26. A weighted check valve 82 is interposed in line 80 for controlling flow through the latter. Moreover, a return line 84 is provided which is coupled to the media outlet 46 of exchanger 14, and to the return main associated with the zoned heating lines 28. A pump 85 is interposed in line 84 as illustrated.

In the use of the apparatus of the invention, the existing hot water heater 12 is turned off, and the drain cock (not shown) forming a part thereof is removed from the opening 38. At this point the outer pipe 66 is installed within the opening 38, whereupon the housing and pump structure, with the elongated inner pipe 64 affixed thereto, is attached to the outer threaded end of the pipe 66. The conduits 76, 78 are next coupled to the openings 74, 58 respectively, and these conduits are then similarly connected to the exchanger 14 at the inlet and outlet 40, 42. The exchanger 14 is also operably coupled with the boiler 22 in the manner described, through the use of the lines 80, 84 which are connected to the exchanger 14 and boiler 22 in the manner familiar to those skilled in the art.

Advantageously the boiler operating unit is wired so that the boiler will operate only on call for heat from one of the zones of the heating system, or from the heater/storage tank 12. Such a wiring hookup is well within the skill of the art, and in effect creates a desirable, energy-efficient, on-demand system both for spacing heating and heating of domestic water. In operation, when a need for domestic hot water is sensed, pump 20 is activated in order to withdraw initially cold water from the heater 12 (which now functions merely as a storage tank), whereupon this cold water is delivered to exchanger 14 through inlet 40. Pump 85 is activated simultaneously with pump 20, which serves to open the check valve 82, and hot water from the boiler 22 then passes through conduit 80 to the exchanger 14. In the exchanger, the heat exchanger media in the form of hot boiler water passes in indirect thermal interchange relationship with the domestic water, thereby serving to heat the latter. Heated domestic water then passes through outlet 42 and conduit 78 through opening 58, chamber 52 and pipe 64 into the confines of the heater 12. It will be seen in this regard that provision of the longer inner pipe 64 (relative to the outer pipe 66) assures that water is delivered to the heater 12 at a point spaced from the inlet end of pipe 66, in order to minimize the recirculation of heated water. Of course, when the supply of hot domestic water in heater 12 is again adequate, pumps 20, 85 are shut down and valve 82 is closed.

Figure 3:
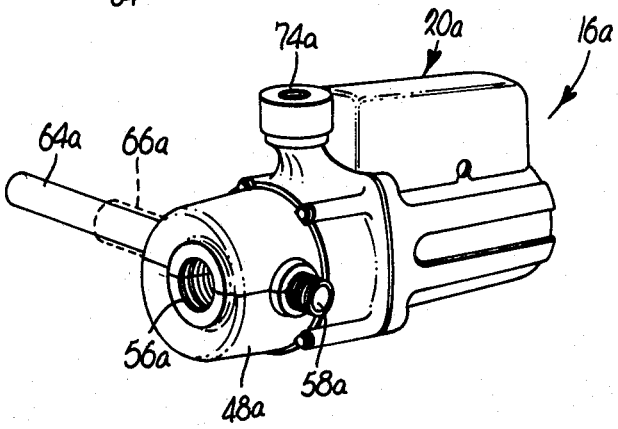
FIG. 3 is a perspective view similar to that of FIG. 2, but depicts another type of circulator fitting in accordance with the invention.
Figure 5:
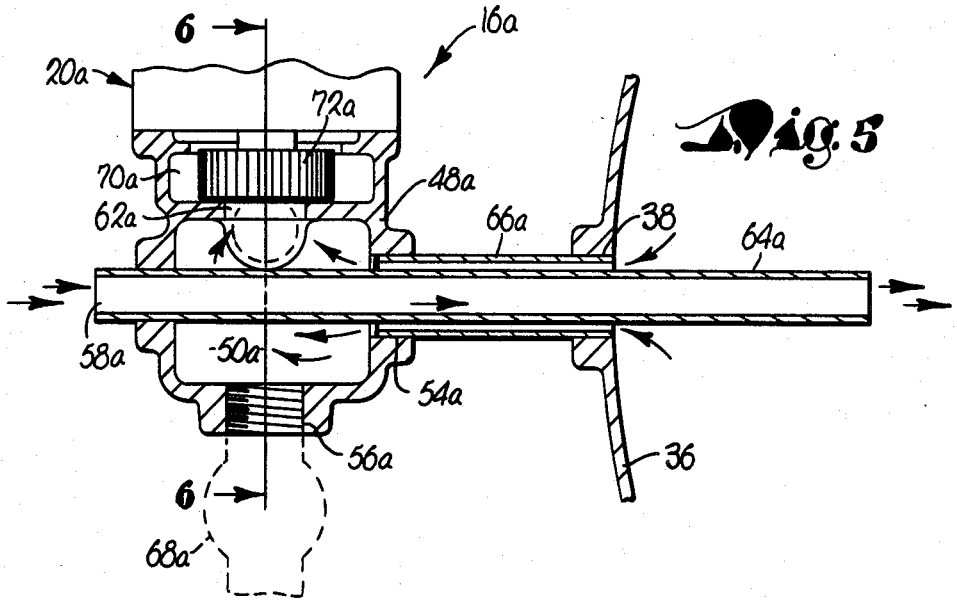
FIG. 5 is a fragmentary bottom sectional view illustrating the details of construction of the embodiment of FIG. 3.
Figure 6:
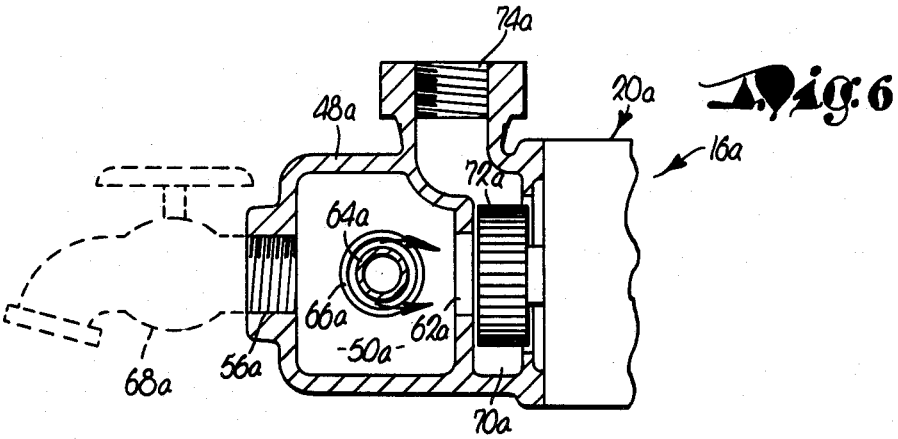
FIG. 6 is a sectional view taken along line 6—6 of FIG. 5.

The embodiment of the circulator fitting illustrated in FIGS. 3 and 5–6 is in many respects identical to that described above in connection with FIGS. 2 and 4. Accordingly, like parts will be similarly numbered in both embodiments, with the provision of an identifying letter "a" to denote the corresponding parts of the second embodiment. Thus, the fitting **16*a* includes a housing 48*a* which includes walls defining but a single internal chamber 50*a*, with threaded openings 54*a* and 56*a* being provided through the chamber-defining walls. A port 62*a* is also provided in housing wall adjacent pump 20*a*. The port 62*a* serves to communicate the chamber 50*a* and the pump chamber 70*a*, the latter having impeller 72*a*** positioned therewithin.

A drain cock **68*a* is operatively positioned within the opening 56*a*, whereas outer pipe 66*a* is threadably received within opening 54*a*. The fitting 16*a* further includes an elongated inner pipe 64*a* which coaxially passes through the pipe 66*a*, and also completely through the housing 48*a*, exiting at the end of the latter remote from the connection of pipe 66*a*. Thus, it will be seen that the inner pipe 64*a* does not communicate with any internal housing chamber, but rather presents an open connection end 58*a* analogous to the opening 58 provided in the first described embodiment. As best seen in FIGS. 2 and 6, the pump 20*a* associated with the overall fitting structure 16*a* has an outlet opening 74*a***.

The use of fitting **16*a* is substantially identical with that described in connection with fitting 16. The only difference involves the fact that conduit 78 is directly coupled to the outlet end 58*a* of pipe 64*a*, rather than to a threaded opening 58 provided with the housing of the first-described embodiment. In all other respects, use of the fitting 16*a* corresponds with that of the preferred fitting 16**.

It will thus be seen that the present invention provides a greatly improved apparatus which can be simply and easily installed to convert a conventional hot water heater into a storage tank, and to give energy-efficient external heating of domestic hot water supplies, using heat derived from a boiler or the like. This result is obtained without extensive modifications of the hot water tank, as has been required in the past.

I claim:

1. A water heating system comprising, in combination:

space heating apparatus including a water heating boiler having lines of delivery of hot water from the boiler to zones to be heated and lines provided with pump means for returning cold water from said zones to the boiler;

a heat exchanger having a pair of separate tubular components in thermal interchange relationship, a first line for flow of hot water from the boiler through one of said tubular components thereof, and a second line provided with pump means for returning cold water from said one tubular component to the boiler;

a hot water storage tank having a first conduit for flow of hot water thereto from the other tubular component of said heat exchanger and a second conduit for flow of cold water from said storage tank through said other tubular component;

a hollow circulator fitting interposed between said storage tank and the heat exchanger and having a first pipe connecting said circulator fitting and the tank for flow of cold water from the tank into the fitting, said fitting having a pump provided with an impeller therewithin for conveying cold water from said fitting to said second conduit; and a second pipe for conveyance of hot water from the first conduit to the tank, said second pipe extending through the first pipe into the tank beyond the first pipe.

* * * * *